US005104923A

United States Patent [19]

Steinwand et al.

[11] Patent Number: 5,104,923

[45] Date of Patent: Apr. 14, 1992

[54] BINDERS FOR IMPARTING HIGH WET STRENGTH TO NONWOVENS

[75] Inventors: Paul J. Steinwand, Placentia; Dennis P. Stack, Santa Ana, both of Calif.

[73] Assignee: Union Oil Company of California, Los Angeles, Calif.

[21] Appl. No.: 332,521

[22] Filed: Mar. 31, 1989

[51] Int. Cl.[5] ..... C08L 33/20

[52] U.S. Cl. ..... 524/461; 524/458; 524/321; 524/322; 524/804; 524/501; 524/502; 524/773; 524/774; 524/775; 524/776; 428/288

[58] Field of Search ..... 524/804, 501, 502, 458, 524/321, 461, 322, 773–776; 428/286

[56] References Cited

U.S. PATENT DOCUMENTS 4,743,498 5/1988 Kedrowski ..... 428/288

FOREIGN PATENT DOCUMENTS 0224736 10/1987 European Pat. Off. .

*Primary Examiner*—Paul R. Michl
*Assistant Examiner*—T. McDonald, Jr.
*Attorney, Agent, or Firm*—Gregory F. Wirzbicki; Michael A. Kondzella

[57] ABSTRACT

A non-polymerizable polycarboxylate imparts greater wet strength to nonwovens bound by an emulsion polymer containing a polymerizable cross-linker.

73 Claims, No Drawings

BINDERS FOR IMPARTING HIGH WET STRENGTH TO NONWOVENS

FIELD OF THE INVENTION

This invention relates to nonwoven fabrics. In one of its more particular aspects it relates to binders capable of imparting high wet strength to nonwoven fabrics into which they are incorporated.

BACKGROUND OF THE INVENTION

During the past few years there has been a substantial growth in the production of high-strength paper and cloth products having a nonwoven, randomly-oriented structure, bonded with a polymeric resin binder. Such products are finding wide use as high-strength, high-absorbency materials for disposable items such as consumer and industrial wipes or towels, diapers, surgical packs and gowns, industrial work clothing and feminine hygiene products. They are also used for durable products such as carpet and rug backings, apparel interlinings, automotive components and home furnishings, and for civil engineering materials such as road underlays. There are several ways to apply a binder to these materials, including spraying, print binding, and foam application. Further, depending on the end use, various ingredients such as catalysts, cross-linkers, surfactants, thickeners, dyes, and flame retardant salts may also be incorporated into the binder.

In the high-speed, high-volume manufacture of cellulosic products such as wet wipes, an important binder property is a fast cure rate; i.e., the finished product must reach substantially full tensile strength in a very short time after binder application so that production rates are not unduly slowed down. In these products, such a property is usually obtained by using a binder which is either self cross-linkable or by incorporating an external cross-linker into the binder formulation. The cross-linker or self cross-linkable binder apparently not only interacts with the binder monomers but with the hydroxyl groups on the cellulose fibers as well to quickly form very strong bonds.

As the need for stronger nonwovens developed, a variety of cross-linking agents for the base binders was utilized. N-methylolacrylamide and other similar cross-linkers were incorporated into the binders. While the strength of the nonwovens increased desirably, it was discovered that many of these cross-linking agents, especially N-methylolacrylamide and similar materials, emitted formaldehyde during use. The toxicity of formaldehyde caused users to search for non-formaldehyde emitting alternatives. An example of a non-formaldehyde emitting cross-linker is methyl acryloamidoglycolate methyl ether (MAGME). However, while MAGME improved the strength of many copolymeric binders and did not emit formaldehyde, the need for further improving the strength, especially the wet strength of many copolymeric binders, led to the use of various other techniques for strength improvement.

One method of providing a fast curing, "zero" formaldehyde binder for nonwoven cellulosic materials utilized a binder comprising a solution copolymer formed by reacting a mixture of two or more water soluble olefinically unsaturated organic comonomers. The solution copolymer was admixed with a non-formaldehyde emitting latex to produce a final composition which, when cured on nonwoven cellulosic material, achieved about 80 percent of fully cured wet tensile strength in 8 seconds or less and which had essentially no emission of formaldehyde from the finished nonwoven.

While this approach resulted in providing zero formaldehyde emitting binders which had improved wet strengths and which were capable of fast curing, it has been found that solution polymers may raise the viscosity and cause thickening of the binders in which they are incorporated. While the viscosity may be varied within certain ranges, in certain applications it is desirable to maintain the viscosity of the binder at a relatively low level in order to assure adequate penetration of the binder into the nonwoven substrate. Accordingly, a method of providing high strength nonwovens which does not fully depend upon the incorporation of large quantities of solution copolymers was needed.

SUMMARY OF THE INVENTION

In accordance with the present invention, a fast curing binder for nonwoven cellulosic materials which can be used to impart high wet strength to nonwovens in which it is incorporated is provided. The binder utilizes a nonpolymerizable polycarboxylate as a catalyst for a cross-linking agent which is incorporated with the copolymeric latex used in formulating binders for nonwovens. In an especially preferred embodiment the polycarboxylate is used with a binder comprising the product of interaction of a copolymeric latex and an aqueous solution polymer. The use of the polycarboxylate results in nonwoven fabrics having improved wet tensile strengths especially after aging.

DETAILED DESCRIPTION OF THE INVENTION

The present invention comprises improved binders for nonwoven fabrics. Such binders generally comprise an aqueous emulsion polymer latex formed by the copolymerization of a mixture of comonomers and may include a solution polymer as well. A nonpolymerizable polycarboxylate is utilized in the process of preparation of the binder. The polycarboxylate serves as a catalyst for a cross-linking agent which is incorporated with the latex. The nonpolymerizable polycarboxylate can be any weak acid. Examples of polycarboxylates which can be used in this invention include oxalic acid, malonic acid, succinic acid, malic acid, citric acid and ethylenediamine tetraacetic acid (EDTA). The acid can be partially or fully neutralized with a base to form a salt, provided the base is volatile during processing. Ammonium oxalate and ammonium citrate are particularly preferred.

The polycarboxylate is conveniently added as a dilute solution to the latex before it is applied to the nonwoven. By keeping the mixture at a pH of about 7.0, it can be kept stable indefinitely. If used immediately a lower pH can be utilized. If desired, the polycarboxylate may be added to the reactor prior to polymerizing the comonomers provided the pH is suitably adjusted. The polycarboxylate is typically added in a concentration of about 0.10 percent to about 3 percent and preferably about 0.3 percent to about 1.0 percent.

The latex of the present invention typically comprises a conjugated diolefin copolymer containing about 10 to about 95 weight percent of one or more alkenyl aromatic monomers and about 5 to about 90 weight percent of one or more conjugated diolefins having 4 to about 8 carbon atoms. These copolymers can be either random or block interpolymers. Illustrative alkenyl aromatic monomers include, for example, styrene, alpha-methylstyrene, p-methylstyrene, chlorostyrene and methylbromostyrene. Illustrative conjugated diolefin monomers include, for example, butadiene and isoprene. The alkenyl aromatic monomer is preferably present in a concentration of about 20 to about 80 weight percent, most preferably about 40 to about 70 weight percent, while the conjugated diolefin monomer is typically present in a concentration of about 20 to about 80 weight percent, most preferably about 30 to about 60 weight percent.

The conjugated diolefin polymers can contain various other monomers in addition to the alkenyl aromatic monomer and the conjugated diolefin monomer, such as vinyl esters of carboxylic acids, mono-olefins, olefinically unsaturated nitriles, olefinically unsaturated carboxylic acids, or olefinically unsaturated carboxylic acid esters. In an especially preferred embodiment, itaconic acid is copolymerized with styrene and butadiene. The itaconic acid is typically present in a quantity of about 0.5 percent to about 5 percent, by weight, of monomers and is usually added at the start of the polymerization or continuously throughout the polymerization. In addition, other latexes than conjugated diolefin copolymer latexes can be used in the present invention. For example, acrylic latexes, vinyl acrylic latexes, vinyl chloride latexes, vinyl acetate latexes, vinylidene chloride latexes and nitrile latexes can be used.

The latexes of the present invention can be prepared by free radical solution and emulsion polymerization methods including batch, continuous and semicontinuous procedures. For the purposes of this invention disclosure, free radical polymerization methods are intended to include radiation polymerization techniques. Illustrative free-radical polymerization procedures suitable for preparing aqueous polymer emulsions involve gradually adding the monomer or monomers to be polymerized simultaneously to an aqueous reaction medium containing a free radical catalyst at rates proportionate to the respective percentage of each monomer in the finished polymer. Optionally, copolymers can be obtained by adding one or more comonomers disproportionately throughout the polymerization so that the portions of the polymers formed during the initial polymerization stage comprise a monomer composition differing from that formed during intermediate or later stages of the same polymerization. For instance, a styrene-butadiene copolymer can be formed by adding a greater proportion or all of the styrene during the initial polymerization stages with the greater proportion of the butadiene being added later in the polymerization.

Illustrative free-radical catalysts are free radical initiators such as hydrogen peroxide, potassium or ammonium peroxydisulfate, dibenzoyl peroxide, lauroyl peroxide, ditertiarybutyl peroxide, 2,2'-azobisisobutyronitrile, either alone or together with one or more reducing components such as sodium bisulfite, sodium metabisulfite, glucose, ascorbic acid or erythorbic acid. Ultraviolet (UV) and electron beam polymerization methods suitable for initiating free radical polymerization are discussed in the Handbook of Pressure-Sensitive Adhesive Technology, particularly at pages 586–604 and the references cited therein. The foregoing references are incorporated herein in their entireties by reference.

Physical stability of the dispersion usually is achieved by providing in the aqueous reaction medium one or more nonionic, anionic, and/or amphoteric surfactants including copolymerizable surfactants such as sulfonated alkylphenol polyalkyleneoxy maleate, sulfoethyl methacrylate, or alkenyl sulfonates. Illustrative of nonionic surfactants are alkylpolyglycol ethers such as ethoxylation products of lauryl, oleyl, or stearyl alcohols or mixtures of alcohols such as coconut fatty alcohols; alkylphenol polyglycol ethers such as ethoxylation products of octyl- or nonylphenol, diisopropylphenol, triisopropylphenol, or di- or tritertiarybutyl phenol. Illustrative of anionic surfactants, for example, are alkali metal or ammonium salts of alkyl, aryl, or alkylaryl sulfonates, sulfates, phosphates or phosphonates. Specific examples include sodium lauryl sulfate, sodium octylphenol glycolether sulfate, sodium dodecylbenzene sulfonate, sodium lauryl diglycol sulfate, ammonium tritertiarybutylphenol penta- and octa-glycol sulfates, dioctyl sodium sulfosuccinate, alpha-olefin sulfonates and sulfonated biphenyl ethers. Numerous other examples of suitable surfactants are disclosed in U.S. Pat. No. 2,600,831, the disclosure of which in its entirety is incorporated herein by reference.

Those skilled in the art of emulsion polymers will appreciate that protective colloids, fillers, extenders, colorants, tackifiers, and other additives which are compatible with the polymer emulsion can be added, if desired.

The polymerization reaction is typically conducted with agitation at a temperature sufficient to maintain an adequate reaction rate until most or all monomers are consumed. Temperatures of about 120° to about 190° F. are generally used. Temperatures of about 150° to about 170° F. are preferred. Monomer addition is usually continued until the latex reaches a polymer concentration of about 20 to about 70 weight percent and preferably about 40 to about 50 weight percent.

A chain transfer agent may be added to the reaction mixture where it is desired to produce a lower molecular weight copolymer. Examples of chain transfer agents, which are added in amounts of about 0.1 to about 5 percent by weight of monomers, are organic halides such as carbon tetrachloride and tetrabromide, alkyl mercaptans, such as secondary and tertiary butyl mercaptan, and thiol substituted polyhydroxyl alcohols, such as monothiolglycerine.

Where a solution polymer is used with the latex, the solution polymer comprises a polymeric composition formed by the solution copolymerization of a mixture containing at least two water soluble monomers.

The first of these water-soluble comonomers comprises one or more organic compounds having at least one olefinically unsaturated linkage with at least one carboxylate group, said compounds having the general formula:

$$R_1-\underset{R_2}{\underset{|}{C}}=\underset{R_3}{\underset{|}{C}}-X-\underset{O}{\underset{\|}{C}}-OR_4 \qquad \text{(a)}$$

wherein $R_1$, $R_2$, and $R_3$ are independently hydrogen, halogen, nitro, amino, and organic groups; $R_4$ is hydrogen or an organic radical, usually containing no more than about 10 carbon atoms; and X is a covalent bond or an organic radical, usually of no more than about 10 carbon atoms. Normally, the number of all the carbon atoms in compound (a) is no greater than 30.

This first comonomer is reacted with either (1) a second water-soluble comonomer comprised of one or more compounds having the general formula:

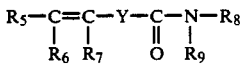

(b)

wherein $R_5$, $R_6$, and $R_7$ are independently selected from nitro, hydrogen, halogen, amino, and organic radicals; $R_8$ and $R_9$ are hydrogen or organic radicals, preferably having no more than 6 carbon atoms; and Y is a covalent bond or an organic radical, usually of no more than about 10 carbon atoms; or (2) one or more water-soluble compounds having the general formula:

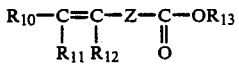

(c)

wherein $R_{10}$, $R_{11}$, and $R_{12}$ are independently selected from hydrogen, halogen, nitro, amino, and organic radicals, usually of no more than 10 carbon atoms; $R_{13}$ is an organic radical having at least 2, and usually no more than 10, carbon atoms, with at least one of $R_{10}$, $R_{11}$, $R_{12}$, and $R_{13}$ being an organic radical having a hydroxyl substituent thereon, said hydroxyl substituent being at least 2 carbon atoms away from the carboxylate group; and Z is a covalent bond or an organic radical, usually of no more than 10 carbon atoms; or (3) a mixture of compounds (b) and (c).

Where in compound (c) one or more of $R_{10}$, $R_{11}$, and $R_{12}$ are organic radicals having a hydroxyl substituent, R is preferably an unsubstituted hydrocarbyl radical, usually of no more than 10 carbon atoms.

The term "organic" radical, when used herein, broadly refers to any carbon-containing radical. Such radicals may be cyclic or acyclic, may have straight or branched chains, and can contain one or more hetero atoms such as sulfur, nitrogen, oxygen, phosphorus, and the like. Further, they may be substituted with one or more substituents such as thio, hydroxy, nitro, amino, nitrile, carboxyl and halogen. In addition to aliphatic chains, such radicals may contain aryl groups, including arylalkyl and alkylaryl groups, and cycloalkyl groups, including alkyl-substituted cycloalkyl and cycloalkyl-substituted alkyl groups, with such groups, if desired, being substituted with any of the substituents listed herein above. When cyclic groups are present, whether aromatic or nonaromatic, it is preferred that they have only one ring. The term "water soluble" shall denote a solubility in an amount of at least 2.5%, by weight, at a temperature of about 90° C. in deionized water. Preferably the comonomers are soluble in water to the extent of at least 5%, and most preferably at least 15%, by weight.

Preferred organic radicals for compounds (a), (b), and (c) are, in general, free of olefinic and alkynyl linkages and also free of aromatic groups. In compound (a), it is further preferred that $R_1$, $R_2$, and $R_3$ be hydrogen or unsubstituted cycloalkyl or unsubstituted, straight or branched alkyl groups which have no more than 7 carbon atoms, with the exception that at least one of $R_1$, $R_2$, and $R_3$ may either be or bear a nitrile or a carboxylate

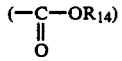

wherein $R_{14}$ is hydrogen or an organic radical, usually having no more than about 10 carbon atoms. More preferably, $R_1$, $R_2$, and $R_3$, except for the group or groups being or bearing the nitrile or carboxylate group, are hydrogen or unsubstituted, straight or branched chain alkyl groups having no more than 5 carbon atoms. When X is an organic radical, it preferably has no more than 6 carbon atoms and is an unsubstituted, branched or unbranched alkyl or unsubstituted cycloalkyl radical and, when an alkyl group, is most preferably unbranched.

In the most preferred form of all, compound (a) is a dicarboxylic acid wherein $R_1$, $R_2$, and $R_3$ are all independently hydrogen, carboxylate groups, or ethyl or methyl groups, either unsubstituted or substituted with a carboxylate group, provided that $R_1$, $R_2$, and $R_3$ comprise, in total, only one carboxylate group. Most preferred for R and $R_{14}$ are hydrogen and unsubstituted alkyl or unsubstituted cycloalkyl groups, provided at least one of $R_4$ and $R_{14}$ is hydrogen. Most preferred for X is a covalent bond.

In particular regard to the most preferred embodiment of the water-soluble comonomer of compound (a), it is still more preferred that, except for the carboxylate groups, the remainder of the compound be unsubstituted; i.e., consist of only carbon and hydrogen atoms, and that the maximum number of carbon atoms in the compound be 27; with $R_1$ and $R_2$ combined having no more than 9, and $R_3$ no more than 8; with $R_4$ and $R_{14}$ having no more than 7 carbon atoms, provided that at least one of $R_4$ and $R_{14}$ is hydrogen. In the very most preferred embodiment, each side of the olefinic linkage has no more than about 5 carbon atoms, at least one of $R_1$, $R_2$, and $R_3$ is or contains the carboxylate

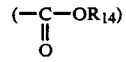

group, and both of $R_4$ and $R_{14}$ are hydrogen.

For compound (b), it is preferred that $R_5$, $R_6$, and $R_7$ be free of carboxylate substituents and, even more preferably, that they be hydrogen or unsubstituted cycloalkyl or unsubstituted, straight or branched alkyl groups which have no more than 7 carbon atoms. Most preferably, $R_5$, $R_6$, and $R_7$ are hydrogen or straight or branched, unsubstituted alkyl groups having no more than 5 carbon atoms. In the very most preferred form of all, $R_5$, $R_6$ and $R_7$ are all independently ethyl, methyl, or hydrogen. Preferred for $R_8$ and $R_9$ are hydrogen or unsubstituted, branched or unbranched, alkyl or unsubstituted cycloalkyl groups each having no more than 6 carbon atoms, provided that at least one of $R_8$ and $R_9$ is hydrogen. When Y is an organic radical, it is preferably an unsubstituted, branched or unbranched alkyl or unbranched cycloalkyl group with no more than about 6 carbon atoms and, when an alkyl group, is more preferably unbranched. However, most preferred for Y is a covalent bond.

For compound (c), it is preferred that $R_{10}$, $R_{11}$, and $R_{12}$ be free of hydroxyl and carboxylate substituents and, even more preferably, that they be hydrogen or unsubstituted cycloalkyl or unsubstituted, straight or branched chain alkyl groups which have no more than 7 carbon atoms. Most preferably, $R_{10}$, $R_{11}$, and $R_{12}$ are hydrogen or unsubstituted, straight or branched chain alkyl groups having no more than 5 carbon atoms. In the very most preferred form of all, $R_{10}$, $R_{11}$, and $R_{12}$ are all independently ethyl, methyl, or hydrogen. $R_{13}$ is also preferably free of carboxylate groups and is most preferably an alkyl or cycloalkyl group, with the required hydroxyl group being substituted at least 2 carbon atoms away from the carboxylate group. When Z is an organic radical, it is preferably a branched or unbranched, unsubstituted alkyl or unsubstituted cycloalkyl group with no more than about 6 carbon atoms and, when an alkyl group, is preferably unbranched. However, most preferred for Z is a covalent bond.

Suitable polymerizable, water-soluble monomers for compound (a) according to the above most preferred description include monoolefinically unsaturated diacids, such as tetrahydrophthalic acid, methylenesuccinic acid (itaconic acid), the cis- and trans- forms of butenedioic acid (maleic and fumaric acids), and both the cis- and trans- forms (where such exist) of the diacids resulting when one or more of the hydrogen atoms on the carbon chains of maleic/fumaric acid or itaconic acid is replaced with a methyl or ethyl group, as well as the $C_1$ to $C_{10}$ and, preferably, $C_1$ to $C_5$ semi-esters of these acids. Of these, itaconic acid and maleic acid are most preferred.

Preferred polymerizable water-soluble, unsaturated compounds according to the above most preferred description for formula (b) are the primary and secondary amides of acrylic and methacrylic acid, with $R_8$ being hydrogen and $R_9$ being either hydrogen, methyl, or ethyl. Of the amido compounds meeting these criteria, acrylamide is most preferred.

Preferred polymerizable, water-soluble, unsaturated compounds according to the above most preferred description for compound (c) are the hydroxy alkyl and hydroxy cycloalkyl esters of acrylic and methacrylic acids, and while the esterifying moiety must have at least 2 carbon atoms, it preferably has no more than about 6, and, more preferably, no more than about 4 carbon atoms. Of the hydroxy alkyl and hydroxy cycloalkyl esters of acrylic and methacrylic acids meeting these criteria, 2-hydroxyethyl acrylate is most preferred.

The copolymerization reaction is conducted with between about 0.1 part and about 9 parts, by weight, of either compound (b) or (c) alone or each of compounds (b) and (c) together, for each part of compound (a).

Where compounds (a) and (b) or (a) and (c) are copolymerized to form the solution polymer, a comonomeric mixture comprising between about 0.1 and about 9.0 parts, by weight, and, preferably, between about 0.3 and about 3 parts, by weight, of compound (b) or compound (c) to 1 part of one of the acid monomers of compound (a), particularly the dicarboxylic acid forms thereof, has been found to be particularly efficacious in producing a solution copolymer for the fast-curing binders of the present invention.

Where compounds (a), (b) and (c) are copolymerized to form the solution polymer, the comonomeric mixture preferably comprises between about 0.3 and about 3.0 parts, by weight, but, more preferably, between about 0.75 and about 1.5 parts, by weight, of each of the preferred compounds for (b) and (c) to 1 part of one of the preferred dicarboxylic acid monomers of compound (a).

In order to produce the solution polymer, in addition to the basic comonomeric charge, as described above, one can also add a number of other agents to the mixture. It will be understood that any percentage values hereinafter given and in the claims for such agents are each based on the basic monomeric charge. Thus, for example, the solution copolymeric composition may optionally contain up to about 20 weight percent of one or more polymerizable, monoolefinically unsaturated nonionic monomers to serve as extenders, $T_g$ modifiers, etc. without significantly degrading its basic properties. Suitable additive monomers for such purposes include the $C_1$ to $C_5$ saturated esters of acrylic and methacrylic acid, vinylidene chloride and vinyl compounds such as vinyl chloride, vinyl acetate, styrene, and the like. Preferred additive monomers are ethyl acrylate, butyl acrylate and styrene.

Suitable copolymers of components (a), (b), and (c) can be prepared by either thermal or, preferably, free-radical initiated solution polymerization methods. Further, the reaction may be conducted by batch, semi-batch, and continuous procedures, which are well known for use in conventional polymerization reactions. Where free-radical polymerization is used, illustrative procedures suitable for producing aqueous polymer solutions involve gradually adding the monomer or monomer to be polymerized simultaneously to an aqueous reaction medium at rates proportionate to the respective percentage of each monomer in the finished copolymer and initiating and continuing said polymerization with a suitable reaction catalyst. Optionally, one or more of the comonomers can be added disproportionately throughout the polymerization so that the polymer formed during the initial stages of polymerization will have a composition and/or a molecular weight differing from that formed during the intermediate and later stages of the same polymerization reaction.

Illustrative water-soluble, free-radical initiators are hydrogen peroxide and an alkali metal (sodium, potassium, or lithium) or ammonium persulfate, or a mixture of such an initiator in combination with a reducing agent activator, such as a sulfite, more specifically an alkali metabisulfite, hyposulfite or hydrosulfite, glucose, ascorbic acid, erythorbic acid, etc. to form a "redox" system. Normally the amount of initiator used ranges from about 0.01% to about 5%, by weight, based on the monomer charge. In a redox system, a corresponding range (about 0.01 to about 5%) of reducing agent is normally used.

The reaction, once started, is continued, with agitation, at a temperature sufficient to maintain an adequate reaction rate until most, or all, of the comonomers are consumed and until the solution reaches a polymer solids concentration between about 5 percent and about 40 percent, by weight. Reaction temperatures in the range of about 10° C. to about 100° C. will yield satisfactory polymeric compositions. When persulfate systems are used, the solution temperature is normally in the range of about 60° C. to about 100° C., while, in redox systems, the temperature is normally in the range of about 10° C. to about 70° C., and preferably about 30° C. to about 60° C. At this point, the solution normally will have a viscosity in the range between about 10 cps and about 1000 cps at a solids content of 15 percent at pH 3.

In general, where a solution polymer is used with a latex the solution polymer is present in an amount of about 1 percent to about 20 percent, by weight of total monomers. Preferably, the solution polymer is present in a concentration of about 2 percent to about 5 percent, by weight.

To impart the fast-curing properties needed for cellulose binder compositions, the polymeric latex may be formulated with a cross-linker or other reactive monomer being added during the polymerization thereof.

The most effective prior art cross-linkers commonly used with these latexes are all known formaldehyde emitters, such as methoxymethyl melamine, N-methylolacrylamide, and glyoxal bisacrylamide. However, by using as a cross-linker about ½ percent to about 15 percent, by weight, of one or more low or non-formaldehyde emitting, polymerizable reactive monomers, selected from methyl acryloamidoglycolate, methyl acryloamidoglycolate methyl ether, and isobutoxymethyl acrylamide, a zero formaldehyde or low formaldehyde binder can be provided. The resulting binders have wet tensile strengths substantially equivalent or superior to those of prior art formaldehyde emitting binders.

However, by using the polycarboxylate described above as a catalyst for the cross-linker, wet tensile strengths significantly higher than those obtained by the use of the cross-linker or the solution polymer alone can be realized.

The invention is further described by the following examples which are illustrative of specific modes of practicing the invention and are not intended as limiting the scope of the invention as defined in the claims. All percentages are by weight unless otherwise specified. All "parts" of solutions refer to weights of the specified "active" component, rather than "wet" weights.

EXAMPLE 1

A mixture comprised of 67 grams each of itaconic acid, acrylamide and 2-hydroxyethyl acrylate, and about 1154 cc of deionized water, was heated to a temperature of about 75° C., after which a solution of an initiator, comprised of 2 grams of sodium persulfate dissolved in 10 cc of deionized water, was added. This mixture was then heated at 75° C. for 3 hours, after which the pH value of the resultant solution copolymer was adjusted to a pH value of about 7.0 with concentrated ammonium hydroxide. The solution polymer was then cooled.

EXAMPLE 2

A styrene-butadiene-itaconic acid copolymer latex was prepared by adding to a pressure reactor with constant stirring 24.24 parts water, 0.5 parts itaconic acid, 0.8 parts of a 10 percent solution of Aerosol A-196 surfactant (sodium dicyclohexyl sulfosuccinate available from American Cyanamid Co., Wayne, New Jersey), and 0.5 parts of a polystyrene seed, 25 nm particle size. The mixture was heated to 150° F., and 0.2 parts sodium persulfate was added to initiate the reaction. Then 40 parts butadiene, 60 parts styrene, 1.0 part Sulfole 120 mercaptan, (tertiary dodecyl mercaptan available from Phillips Chemical Co., a subsidiary of Phillips Petroleum Co., Bartlesville, OK), dissolved in styrene, an additional 1.2 parts of 10 percent Aerosol A-196, 0.03 parts Versene 100 (sodium ethylene diamine tetraacetate available from Dow Chemical Co., Midland, MI), and 5 parts MAGME-100 (methyl acryloamidoglycolate methyl ether, available from American Cyanamid Co., Wayne, NJ) were added over a 6 hour period. The final mixture was heated at a temperature of 170° F. for 5 hours. The resulting emulsion polymer was cooled and removed from the reactor. It had a pH value of 2.3, which was adjusted to pH 7.0 with ammonium hydroxide. Total solids were 51 percent.

The wet tensile strength was determined as follows. Sets of one-inch wide, nonwoven, randomly-oriented cellulose strips were padded in the binder to obtain a binder add-on of approximately 10 percent. Padding is the process of dipping or saturating a substrate in a bath and squeezing off the excess liquid with nip rollers. The binder-containing strips were dried at 23° C., cured at 188° C. for 6 seconds, and then dipped in a 1 percent solution of Aerosol TO, (sodium octyl sulfosuccinate wetting agent, available from American Cyanamid Co., Wayne, NJ). The wet tensile strengths were measured and found to be 4.4 pounds after curing at 188° C. for 4 seconds, 4.8 pounds after 6 seconds, and 5.0 pounds after 8 seconds. Curing for 180 seconds at 150° C. resulted in a wet tensile strength of 4.3 pounds. After aging one week in 1 percent Aerosol TO surfactant at 66° C., the wet tensile strength was 0.5 pounds. The results described above were compared with similar binders wherein various additives were incorporated into the binder. The additives were introduced as dilute solutions adjusted to pH 7 with ammonium hydroxide, but the percentages are by weight excluding water and ammonium ion. The results in pounds are shown in Table 1 below:

TABLE 1

| | | Wet Tensile Strength, Pounds | | | | |
|---|---|---|---|---|---|---|
| | Dry | Cure, 188° C. | | | Cure 150° C. | Aged |
| Additive | % | 4 sec | 6 sec | 8 sec | 180 sec | Wet |
| Citric Acid | 1 | 4.8 | 5.1 | 5.2 | 4.8 | 0.67 |
| Citric Acid | 2 | 4.7 | 5.0 | 5.1 | 4.8 | 0.72 |
| Oxalic Acid | 1 | 5.0 | 5.1 | 5.2 | 4.6 | 1.18 |
| Oxalic Acid | 2 | 5.2 | 5.0 | 5.1 | 4.8 | 0.98 |
| Solution Polymer of Example 1 | 1 | 4.8 | 5.4 | 5.7 | 5.7 | 0.92 |
| Solution Polymer of Example 1 | 5 | 5.2 | 5.9 | 6.2 | 6.5 | 1.34 |
| NONE | 0 | 4.4 | 4.8 | 5.0 | 4.3 | 0.5 |

EXAMPLE 3

A styrene-butadiene-itaconic acid copolymer latex was prepared by adding to a pressure reactor with constant stirring 23.94 parts water, 0.8 parts itaconic acid, 0.8 parts of a 10 percent solution of Aerosol A-196 surfactant, and 0.5 parts of a polystyrene seed, 25 nm particle size. The mixture was heated to 150° F. and 0.2 parts sodium persulfate was added to initiate the reaction. Then 40 parts butadiene, 60 parts styrene, 1.0 part Sulfole 120 mercaptan, dissolved in styrene, an additional 1.2 parts of 10 percent Aerosol A-196, 0.03 parts Versene 100, and 4 parts MAGME-100 were added over a 6 hour period. The final mixture was heated at 170° F. for 5 hours. The resulting emulsion had a pH value of 2.2 and contained 49.7 percent total solids when it was removed from the reactor. After adjustment to pH 7, it had a total solids content of 49.9 percent and a viscosity of 580 cps. One part of the solution polymer of Example 1 was added as well a varying quantities of oxalic acid. The results are shown in Table 2 below. Each value is the percentage increase of wet tensile strength compared to a control binder which contained no oxalic acid.

TABLE 2

| | Increase of Wet Tensile Strength, % | | | | |
|---|---|---|---|---|---|
| Oxalic | Cure, 188° C. | | | Cure 150° C. | Aged |
| Acid | 4 sec | 6 sec | 8 sec | 180 sec | Wet |
| 0.15 | 6 | 5 | 3 | 4 | 10 |

TABLE 2-continued

| Oxalic Acid | Increase of Wet Tensile Strength, % | | | | |
|---|---|---|---|---|---|
| | Cure, 188° C. | | | Cure 150° C. | Aged |
| | 4 sec | 6 sec | 8 sec | 180 sec | Wet |
| 0.30 | 9 | 6 | 5 | 3 | 26 |
| 0.60 | 15 | 11 | 9 | 10 | 42 |

EXAMPLE 4

A styrene-butadiene-itaconic acid copolymer latex was prepared by adding to a pressure reactor with constant stirring 35.5 parts water, 0.5 parts itaconic acid, 0.7 parts of a 10 percent solution of Aerosol A-196 surfactant and 0.5 parts of a polystyrene seed, 25 nm particle size. The mixture was heated to 150° F. and 0.3 parts sodium persulfate was added to initiate the reaction. Then 40 parts butadiene, 60 parts styrene, 1.0 part Sulfole 120 mercaptan, dissolved in styrene, an additional 1.5 parts of 10 percent Aerosol A-196, 0.03 parts Versene 100, and 4 parts MAGME-100 were added over a 6 hour period. The final mixture was heated at 170° F. for 6 hours. The resulting emulsion had a pH value of 3.2, 46.3 percent solids and a viscosity of 54 cps. After adjustment to pH 7 with ammonium hydroxide, it had a total solids content of 46.6 percent and a viscosity of 75 cps. One part of the solution polymer of Example 1 was added as well as varying quantities of ammonium chloride. The results are shown in Table 3 below. Each value is the percentage change of wet tensile strength compared to a control binder which contained no ammonium chloride. In every case the binder containing ammonium chloride had less wet tensile strength than the control.

TABLE 3

| $NH_4Cl$ % | Change in Wet Tensile Strength, % | | | | |
|---|---|---|---|---|---|
| | Cure, 188° C. | | | Cure 150° C. | Aged |
| | 4 sec | 6 sec | 8 sec | 180 sec | Wet |
| 0.25 | −7 | −3 | −2 | −8 | −11 |
| 0.51 | −11 | −3 | −2 | −4 | −17 |
| 1.02 | −11 | −6 | −8 | −4 | −12 |

This invention may be embodied in other forms without departing from the spirit or essential characteristics thereof. For example, other non-polymerizable polycarboxylates than those specifically exemplified herein, other latexes and other solution polymers may be used in practicing the present invention. Consequently, the present embodiments and examples are to be considered only as being illustrative and not restrictive, with the scope of the invention being indicated by the appended claims. All embodiments which come within the scope and equivalency of the claims are, therefore, intended to be embraced therein.

We claim:

1. A binder for imparting high wet strength to nonwoven cellulosic materials which comprises the product of reaction of an aqueous emulsion polymer, a polymerizable cross-linker for said emulsion polymer, and a nonpolymerizable polycarboxylate.

2. A binder according to claim 1 wherein said emulsion polymer is a member selected from the group consisting of conjugated diolefin polymers, acrylic polymers, vinyl acrylic polymers, vinyl chloride polymers; vinyl acetate polymers, vinylidene chloride polymers and nitrile polymers.

3. A binder according to claim 1 wherein said emulsion polymer comprises the product of copolymerization of about 10 to about 95 weight percent of an alkenyl aromatic monomer and about 5 to about 90 weight percent of a conjugated diolefin containing 4 to about 8 carbon atoms

4. A binder according to claim 1 wherein said emulsion polymer comprises the product of copolymerization of about 20 to about 80 weight percent of an alkenyl aromatic monomer and about 20 to about 80 weight percent of a conjugated diolefin containing 4 to about 8 carbon atoms.

5. A binder according to claim 1 wherein said emulsion polymer comprises the product of copolymerization of about 40 to about 70 weight percent of an alkenyl aromatic monomer and about 30 to about 60 weight percent of a conjugated diolefin containing 4 to about 8 carbon atoms

6. A binder according to claim 1 wherein said emulsion polymer comprises a styrene-butadiene copolymer.

7. A binder according to claim 1 wherein said emulsion polymer comprises a carboxylated styrene-butadiene copolymer.

8. A binder according to claim 1 wherein said emulsion polymer comprises a styrene-butadiene-itaconic acid copolymer.

9. A binder according to claim 1 wherein said emulsion polymer contains about 0 percent to about 5 percent, by weight of monomers, of itaconic acid.

10. A binder according to claim 1 wherein said emulsion polymer contains about 0.5 percent to about 5 percent, by weight of monomers, of itaconic acid.

11. A binder according to claim 1 wherein said polymerizable cross-linker is a non-formaldehyde emitting cross-linker.

12. A binder according to claim 1 wherein said polymerizable cross-linker is a member selected from the group consisting of methyl acryloamidoglycolate, methyl acryloamidoglycolate methyl ether and isobutoxymethyl acrylamide.

13. A binder according to claim 1 wherein said polymerizable cross-linker is methyl acryloamidoglycolate methyl ether.

14. A binder according to claim 1 wherein said polymerizable cross-linker is present in an amount of about ½ percent to about 15 percent, by weight.

15. A binder according to claim 1 wherein said polycarboxylate is a weak acid.

16. A binder according to claim 1 wherein said polycarboxylate is a member selected from the group consisting of oxalic acid, malonic acid, succinic acid, malic acid, citric acid and ethylenediamine tetraacetic acid.

17. A binder according to claim 1 wherein said polycarboxylate is a salt formed by neutralizing a nonpolymerizable polycarboxylic acid with a volatile base.

18. A binder according to claim 17 wherein said salt is a member selected from the group consisting of ammonium oxalate and ammonium citrate.

19. A binder according to claim 1 wherein said polycarboxylate is present in a concentration of about 0.25 percent to about 3 percent, by weight.

20. A binder according to claim 1 wherein said polycarboxylate is present in a concentration of about 1 percent to about 2 percent, by weight.

21. A binder for imparting high wet strength to nonwoven cellulosic materials which comprises the product of reaction of an aqueous emulsion polymer, an aqueous solution polymer, a polymerizable cross-linker for said emulsion polymer and a nonpolymerizable polycarboxylate.

22. A binder according to claim 21 wherein said emulsion polymer is a member selected from the group consisting of conjugated diolefin polymers, acrylic polymers, vinyl acrylic polymers, vinyl chloride polymers; vinyl acetate polymers, vinylidene chloride polymers and nitrile polymers.

23. A binder according to claim 21 wherein said emulsion polymer comprises the product of copolymerization of about 10 to about 95 weight percent of an aklenyl aromatic monomer and about 5 to about 90 weight percent of a conjugated diolefin containing 4 to about 8 carbon atoms.

24. A binder according to claim 21 wherein said emulsion polymer comprises the product of copolymerization of about 20 to about 80 weight percent of a conjugated iolefin containing 4 to about 8 carbon atoms.

25. A binder according to claim 21 wherein said emulsion polymer comprises the product of copolymerization of about 40 to about 70 weight percent of an aklenyl aromatic monomer and about 30 to about 60 weight percent of a conjugated diolefin containing 4 to about 8 carbon atoms.

26. A binder according to claim 21 wherein said emulsion polymer comprises a styrene-butadiene copolymer.

27. A binder according to claim 21 wherein said emulsion polymer comprises a carboxylated styrene-butadiene copolymer.

28. A binder according to claim 21 wherein said emulsion polymer comprises a styrene-butadiene-itaconic acid copolymer.

29. A binder according to claim 21 wherein said emulsion polymer contains about 0 percent to about 5 percent, by weight of monomers, of itaconic acid.

30. A binder according to claim 21 wherein said emulsion polymer contains about 0.5 percent to about 5 percent, by weight of monomers, of itaconic acid.

31. A binder according to claim 21 wherein said solution polymer is a copolymer formed by the reaction of a first water-soluble comonomer comprised of one or more olefinically unsaturated compounds having at least one carboxylate group; said compounds having the general formula:

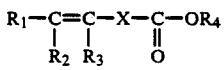

wherein $R_1$, $R_2$, and $R_3$ are independently selected from hydrogen, halogen, nitro, amino, and organic radicals; $R_4$ is hydrogen or an organic radical; and X is an organic radical or a covalent bond; with a member selected from the group consisting of (a) A water soluble comonomer comprised of one or more amides of olefinically unsaturated carboxylic acids, said amides having the general formula:

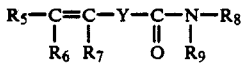

wherein $R_5$, $R_6$ and $R_7$ are independently selected from hydrogen, halogen, nitro, amino and organic radicals; $R_8$ and $R_9$ are hydrogen or organic radicals; and Y is an organic radical or a covalent bond;

(b) a water soluble comonomer comprised of one or more hydroxyalkyl esters of olefinically unsaturated carboxylic acids, said esters having the general formula:

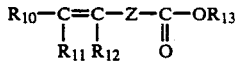

wherein $R_{10}$, $R_{11}$ and $R_{12}$ are independently selected from hydrogen, halogen, nitro, amino and organic radicals; $R_{13}$ is an organic radical having at least 2 carbon atoms; with at least one of $R_{10}$, $R_{11}$, $R_{12}$ and $R_{13}$ being an organic radical containing a hydroxyl substituent thereon, said hydroxyl substituent being located on a carbon atom which is at least 2 carbon atoms away from the carboxylate group shown in the above formula; and Z is an organic radical or a covalent bond; and (c) mixtures of the comonomers defrined in (a) and (b).

32. A binder according to claim 21 wherein said solution polymer is present in a concentration of about 1 percent to about 20 percent, by weight.

33. A binder according to claim 21 wherein said solution polymer is present in a concentration of about 2 percent to about 5 percent, by weight.

34. A binder according to claim 21 wherein said solution polymer comprises the product of copolymerization of itaconic acid, acrylamide and 2-hydroxyethyl acrylate.

35. A binder according to claim 21 wherein said polymerizable cross-linker is a non-formaldehyde emitting cross-linker.

36. A binder according to claim 21 wherein said polymerizable cross-linker is a member selected from the group consisting of methyl acryloamidoglycolate, methyl acryloamidoglycolate methyl ether and isobutoxymethyl acrylamide.

37. A binder according to claim 21 wherein said polymerizable cross-linker is methyl acryloamidoglycolate methyl ether.

38. A binder according to claim 21 wherein said polymerizable cross-linker is present in an amount of about ½ percent to about 15 percent, by weight.

39. A binder according to claim 21 wherein said polycarboxylate is a weak acid.

40. A binder according to claim 21 wherein said polycarboxylate is a member selected from the group consisting of oxalic acid, malonic acid, succinic acid, malic acid, citric acid and ethylenediamine tetraacetic acid.

41. A binder according to claim 21 wherein said polycarboxylate is a salt formed by neutralizing a nonpolymerizable polycarboxylic acid with a volatile base.

42. A binder according to claim 41 wherein said salt is a member selected from the group consisting of ammonium oxalate and ammonium citrate.

43. A binder according to claim 21 wherein said polycarboxylate is present in a concentration of about 0.25 percent to about 3 percent, by weight.

44. A binder according to claim 21 wherein said polycarboxylate is present in a concentration of about 1 percent to about 2 percent, by weight.

45. A process for preparing a binder for imparting high wet strength to nonwoven cellulosic materials which comprises reacting the comonomers of an aqueous emulsion polymer with a polymerizable cross-linker for said emulsion polymer and a non-polymerizable polycarboxylate.

46. A process for preparing a binder for imparting high wet strength to nonwoven cellulosic materials which comprises reacting the comonomers of an aqueous emulsion polymer with a polymerizable cross-linker for said emulsion polymer, and thereafter adding a non-polymerizable polycarboxylate.

47. A process for preparing a binder for imparting high wet strength to nonwoven cellulosic materials which comprises reacting the comonomers of an aqueous emulsion polymer with an aqueous solution polymer, a polymerizable cross-linker for said emulsion polymer and a non-polymerizable polycarboxylate.

48. A process for preparing a binder for imparting high wet strength to nonwoven cellulosic materials which comprises reacting the comonomers of an aqueous emulsion polymer with a polymerizable cross-linker for said emulsion polymer and a non-polymerizable polycarboxylate, and thereafter adding an aqueous solution polymer.

49. A process for preparing a binder for imparting high wet strength to nonwoven cellulosic materials which comprises reacting the comonomers of an aqueous emulsion polymer with an aqueous solution polymer and a polymerizable cross-linker for said emulsion polymer, and thereafter adding a non-polymerizable polycarboxylate.

50. A process for preparing a binder for imparting high wet strength to nonwoven cellulosic materials which comprises reacting the comonomers of an aqueous emulsion polymer with a polymerizable cross-linker and thereafter adding an aqueous solution polymer and a non-polymerizable polycarboxylate.

51. A process according to one of claims 45–50 wherein said emulsion polymer is a member selected from the group consisting of conjugated diolefin polymers, acrylic polymers, vinyl acrylic polymers, vinyl chloride polymers; vinyl acetate polymers, vinylidene chloride polymers and nitrile polymers.

52. A process according to one of claims 45–50 wherein said emulsion polymer comprises the product of copolymerization of about 10 to about 95 weight percent of an alkenyl aromatic monomer and about 5 to about 90 weight percent of a conjugated diolefin containing 4 to about 8 carbon atoms.

53. A process according to one of claims 45–50 wherein said emulsion polymer comprises the product of copolymerization of about 20 to about 80 weight percent of an alkenyl aromatic monomer and about 20 to about 80 weight percent of a conjugated diolefin containing 4 to about 8 carbon atoms.

54. A process according to one of claims 45–50 wherein said emulsion polymer comprises the product of copolymerization of about 40 to about 70 weight percent of an alkenyl aromatic monomer and about 30 to about 60 weight percent of a conjugated diolefin containing 4 to about 8 carbon atoms.

55. A binder according to one of claims 45–50 wherein said emulsion polymer comprises a styrene-butadiene copolymer.

56. A process according to one of claims 45–50 wherein said emulsion polymer comprises a carboxylated styrene-butadiene copolymer.

57. A process according to one of claims 45–50 wherein said emulsion polymer comprises a styrene-butadiene-itaconic acid copolymer.

58. A process according to one of claims 45–50 wherein said emulsion polymer contains about 0 percent to about 5 percent, by weight of monomers, of itaconic acid.

59. A process according to one of claims 45–50 wherein said emulsion polymer contains about 0.5 percent to about 5 percent, by weight of monomers, of itaconic acid.

60. A process according to one of claims 45–50 wherein said polymerizable cross-linker is a non-formaldehyde emitting cross-linker.

61. A process according to one of claims 45–50 wherein said polymerizable cross-linker is a member selected from the group consisting of methyl acryloamidoglycolate, methyl acryloamidoglycolate methyl ether and isobutoxymethyl acrylamide.

62. A process according to one of claims 45–50 wherein said polymerizable cross-linker is methyl acryloamidoglycolate methyl ether.

63. A process according to one of claims 45–50 wherein said polymerizable cross-linker is present in an amount of about ½ percent to about 15 percent, by weight.

64. A process according to one of claims 45–50 wherein said polycarboxylate is a weak acid.

65. A process according to one of claims 45–50 wherein said polycarboxylate is a member selected from the group consisting of oxalic acid, malonic acid, succinic acid, malic acid, citric acid and ethylenediamine tetraacetic acid

66. A process according to one of claims 45–50 wherein said polycarboxylate is a salt formed by neutralizing a nonpolymerizable polycarboxylic acid with a volatile base.

67. A process according to claim 66 wherein said salt is a member selected from the group consisting of ammonium oxalate and ammonium citrate.

68. A process according to one of claims 45–50 wherein said polycarboxylate is present in a concentration of about 0.25 percent to about 3 percent, by weight.

69. A process according to one of claims 45–50 wherein said polycarboxylate is present in a concentration of about 1 percent to about 2 percent, by weight.

70. A process according to one of claims 47–50 wherein said solution polymer is a copolymer formed by the reaction of a first water-soluble comonomer comprised of one or more olefinically unsaturated compounds having at least one carboxylate group, said compounds having the general formula:

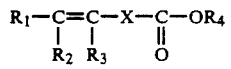

wherein $R_1$, $R_2$, and $R_3$ are independently selected from hydrogen, halogen, nitro, amino, and organic radicals; $R_4$ is hydrogen or an organic radical; and X is an organic radical or a covalent bond; with a member selected from the group consisting of (a) A water soluble comonomer comprised of one or more amides of olefinically unsaturated carboxylic acids, said amides having the general formula:

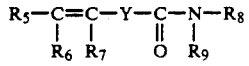

wherein $R_5$, $R_6$ and $R_7$ are independently selected from hydrogen, halogen, nitro, amino and organic radicals; $R_8$ and $R_9$ are hydrogen or organic radicals; and Y is an organic radical or a covalent bond;

(b) a water soluble comonomer comprised of one or more hydroxyalkyl esters of olefinically unsaturated carboxylic acids, said esters having the general formula:

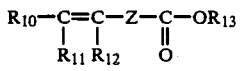

wherein R 10, $R_{11}$ and $R_{12}$ are independently selected from hydrogen, halogen, nitro, amino and organic radicals; $R_{13}$ is an organic radical having at least 2 carbon atoms; with at least one of $R_{10}$, $R_{11}$, $R_{12}$ and $R_{13}$ being an organic radical containing a hydroxyl substituent thereon, said hydroxyl substituent being located on a carbon atom which is at least 2 carbon atoms away from the carboxylate group shown in the above formula; and Z is an organic radical or a covalent bond; and (c) mixtures of the comonomers defined in (a) and (b).

71. A process according to one of claims 47–50 wherein said solution polymer is present in a concentration of about 1 percent to about 20 percent, by weight.

72. A process according to one of claims 47–50 wherein said solution polymer is present in a concentration of about 2 percent to about 5 percent, by weight.

73. A process according to one of claims 47–50 wherein said solution polymer comprises the product of copolymerization of itaconic acid, acrylamide and 2-hydroxyethyl acrylate.

* * * * *

UNITED STATES PATENT AND TRADEMARK OFFICE

CERTIFICATE OF CORRECTION

PATENT NO. : 5,104,923

DATED : April 14, 1992

INVENTOR(S) : Paul J. Steinwand and Dennis P. Stack

It is certified that error appears in the above-identified patent and that said Letters Patent is hereby corrected as shown below:

Claim 24, column 13, line 19, after "of" insert -- an alkenyl aromatic monomer and about 20 to about 80 weight percent of --.

Claim 24, column 13, line 20, replace "iolefin" with -- diolefin --.

Claim 51, column 15, line 38, replace "conjugated" with -- conjugated --.

Claim 70, column 17, line 14, replace "R 10" with -- $R_{10}$ --.

Signed and Sealed this

Seventeenth Day of August, 1993

Bruce Lehman

*Attest:*

BRUCE LEHMAN

*Attesting Officer*

*Commissioner of Patents and Trademarks*